US010010121B2

(12) United States Patent
Kumprey et al.

(10) Patent No.: US 10,010,121 B2
(45) Date of Patent: Jul. 3, 2018

(54) HAND WARMER WITH A SEALABLE END

(71) Applicants: William T Kumprey, New Berlin, WI (US); Troy Kumprey, Redondo Beach, CA (US)

(72) Inventors: William T Kumprey, New Berlin, WI (US); Troy Kumprey, Redondo Beach, CA (US)

( * ) Notice: Subject to any disclaimer, the term of this patent is extended or adjusted under 35 U.S.C. 154(b) by 0 days.

(21) Appl. No.: 15/362,819

(22) Filed: Nov. 29, 2016

(65) Prior Publication Data

US 2018/0146722 A1 May 31, 2018

(51) Int. Cl.
*A41D 13/08* (2006.01)
*A41D 13/005* (2006.01)

(52) U.S. Cl.
CPC ..... *A41D 13/0051* (2013.01); *A41D 13/08* (2013.01); *A41D 2400/10* (2013.01)

(58) Field of Classification Search
CPC ..... A41D 13/08; A41D 13/081
See application file for complete search history.

(56) References Cited

U.S. PATENT DOCUMENTS

| | | | | |
|---|---|---|---|---|
| 4,107,507 | A * | 8/1978 | Schultz | H05H 1/36 219/121.36 |
| 4,495,659 | A | 1/1985 | Madnick | |
| 5,139,187 | A * | 8/1992 | Fowler | A41D 13/081 2/162 |
| 5,499,401 | A | 3/1996 | Heinmiller | |
| 8,615,814 | B1 | 12/2013 | Hawkins | |
| 9,220,307 | B2 * | 12/2015 | Clayton | A41D 19/01 |
| 2006/0248624 | A1 * | 11/2006 | Pieczynski | A41D 13/0051 2/16 |

* cited by examiner

*Primary Examiner* — Tejash Patel
(74) *Attorney, Agent, or Firm* — William Fitzpatrick, Esq.; Eandi Fitzpatrick LLP

(57) ABSTRACT

A hand warmer is disclosed herein. The hand warmer has a central pocket defined by a cylindrical housing and a sealing member proximate an anterior end of the housing, wherein the sealing member is configured switch positions from a closed position to an open position with an application of a pulling or pushing force by the user in a direction parallel an arm of the user. A method of warming a user's hands is also provided.

10 Claims, 5 Drawing Sheets

HAND WARMER WITH A SEALABLE END

CROSS-REFERENCE TO RELATED APPLICATIONS

Not applicable.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF THE INVENTION

The present invention relates generally to a hand warmers. More particularly, the present invention relates to certain new and useful advances for a hand warmer that conveniently switches positions to allow for use of one's fingers when maximum dexterity is required, s reference being had to the drawings accompanying and forming a part of the same.

BACKGROUND

Gloves, mittens and muffs have been used for thousands of years for warming and protecting the hands of their user. Human hands are often exposed to cold weather while working or enjoying recreational activities. They are used to retain heat and shield the cold from effecting the function and pain associated with long exposure of one's hands to the elements of cold weather. Gloves aid in retaining heat and shielding wind while allowing the use of each individual finger. Most gloves have separate sheaths or openings for each finger and the thumb, but may also have an opening but no covering sheath for each finger (e.g., fingerless gloves).

Mittens, on the other hand, do not have separate finer openings, but rather one large sheath. Mittens have been long trusted to keep hands warmer than gloves, but with the disadvantage that mittens generally eliminate the user use of their fingers. A hybrid of a glove and mitten contains open-ended sheaths for the four fingers (e.g., fingerless glove, but not the thumb) and an additional compartment encapsulating the four fingers. This compartment can be lifted off the fingers and folded back to allow the individual fingers ease of movement and access while the hand remains covered.

Fingerless gloves are useful where dexterity is required that gloves or mittens would otherwise restrict. Cigarette smokers and church organists often use fingerless gloves. Some gloves may also include a gauntlet that extends partway up the arm. Cycling gloves for road racing or touring are usually fingerless. Guitar players often use fingerless gloves in circumstances when weather is much too cold to play with an un-covered hand.

However, these past ad-hoc approaches have many drawbacks. For example, fingerless gloves do not keep the user's fingers warm, while gloves and mittens severely restrict dexterity. Furthermore, the hybrid approaches do not sufficiently warm the thumb, nor do they provide the dexterity and maneuverability required for some jobs and activities. For example, if a user needs to quickly and conveniently use their fingers in a very precise fashion (e.g., bow hunting) they must put down whatever may be in their hand, take off the glove or remove the finger hood, and store it in their pocket in the case of gloves, or allow the hood to dangle in the case of a hybrid. Then, to make matters more difficult, to put the glove back on or put after the activity is over the same operation is required. Furthermore, in situations where the user needs to be both fast and silent, such as bow or rifle hunting, these past approaches simply do not work because they are far too noisy, and a bow and arrow requires two hands at all times.

As such, a new hand warmer that obviates the above shortcomings is needed.

SUMMARY OF THE INVENTION

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Accordingly, it is an object of the present invention to provide a hand warmer that provides full dexterity for the fingers of the user based on its adjustment in positioning, and yet provides ample warmth.

Another object of the present invention is to provide a new and improved hand warmer that is easy and inexpensive to construct.

In exemplary embodiments, the hand warmer comprises a central pocket defined by a cylindrical housing and a sealing member proximate an anterior end of the housing, wherein the sealing member is configured switch positions from a closed position to an open position with an application of a pulling or pushing force by the user in a direction parallel an arm of the user.

In exemplary embodiments, a method of warming a user's hands in which a warmer automatically seals an end of the central pocket when the housing is pushed up the arm of the user to the user's hand past the user's fingers Other features, advantages, and aspects of the present invention will become more apparent and be more readily understood from the following detailed description, which should be read in conjunction with the accompanying drawings.

DETAILED DESCRIPTION OF THE INVENTION

Figure 1:
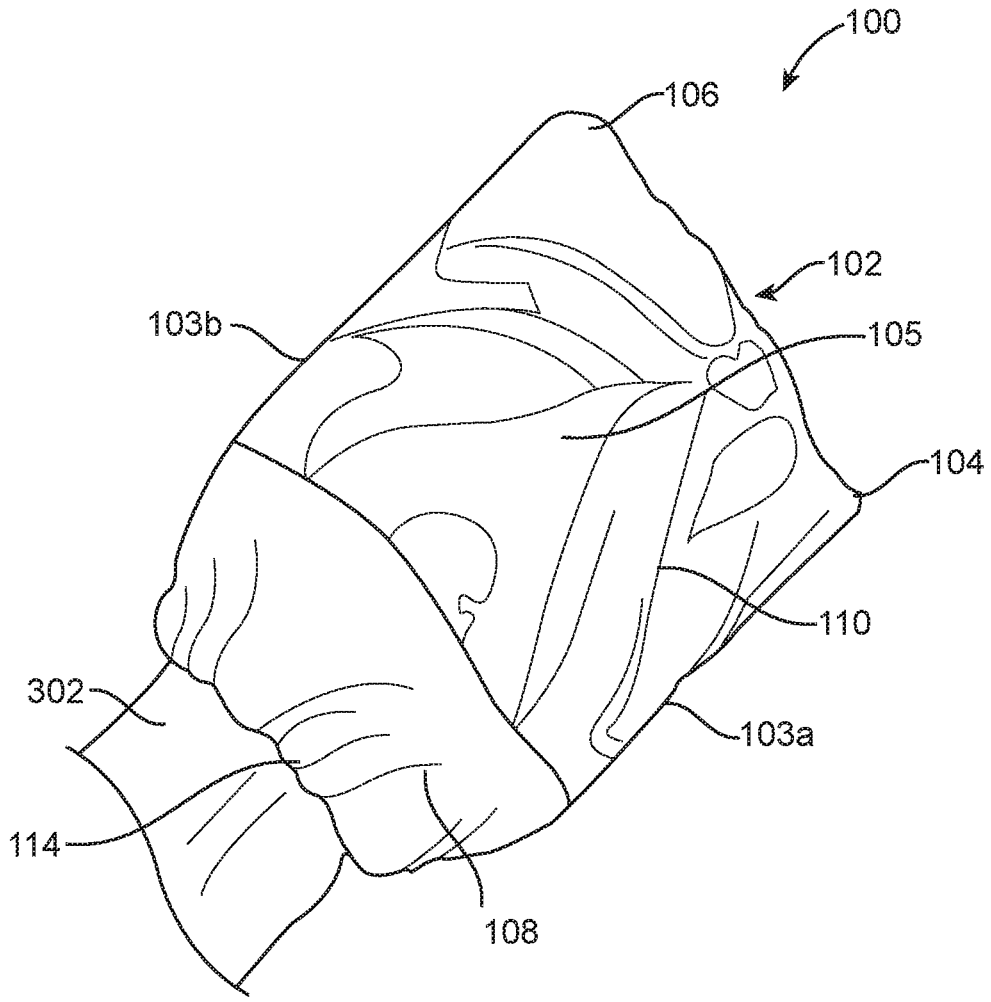
FIG. 1 is a perspective view an insulated hand warmer in the open position in accordance with one embodiment of the present invention.

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described are shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be also understood to refer to functional equivalents of such structures. The present invention will now be described in detail with reference to embodiments thereof as illustrated in the accompanying drawings.

The hand warmer may be manufactured from a soft, deformable, and malleable material, such as vinyl or cloth, which can be composed of natural fibers, synthetic fibers or a combination of both natural and synthetic fibers. The hand warmer may be treated so as to be waterproof. In some embodiments, the warmer comprises or is manufactured from thermo-mechanically expanded PTFE and other fluoropolymer products, such as Gore-Tex®. The interior of the hand warmer may comprise natural and synthetic fibers configured to wick away moisture and provide enough insulation to trap warm air inside the interior. Suitable materials comprise cashmere, wool, fleece and goose down.

Referring now FIG. 1, a perspective view of a hand warmer in accordance with an embodiment of the present invention is shown generally at reference numeral 100. The warmer 100, which is substantially cylindrical in shape, comprises a central pocket 102, which may be opened and closed on a first end 104, sides 103*a* and 103*b*, and exterior shell 105. At or proximate a first end 104 the hand warmer may further comprise a sealing member 106 that is disposed across the first end on a vector adjacent to the y-axis of the glove (e.g., right angle).

The hand warmer further comprises a posterior section 108, and anterior section 110. While these sections are labeled as separate portions, in optional embodiments of the present invention, a single unitary design may be provided. The posterior section 108 comprises a cuff 114, which is attached to the periphery of the posterior section at its most posterior point, and is configured to accept the hand the arm of a user. The cuff 114 is dimensioned to define a narrower opening than the anterior portion, the cuff being configured to form a seal around the user's wrist in the open position, and the user's arm 302 in the closed position, shown in greater detail with reference to FIGS. 2-4. The cuff 114 may comprise an elastomeric material or stetchable fabric.

Sealing member 106 may comprise a plurality of sealing members disposed on the front interior edge. The sealing member 106 is configured to allow the user to easily and comfortably change the sealing member position from closed to open with an application of a pulling force in a direction up a user's arm, to be described in greater detail with relation to FIGS. 2-4. In some embodiments, the member 106 comprises a row or series of automatically resealable members, such as magnets, discussed in greater detail with reference to FIG. 2. In other optional embodiments, the sealing member may comprise any closeable means now known or hereinafter developed, including hook and loop type fasteners such as Velcro® brand fasteners, magnetic tape or snaps such that in operation, the users hand can easily breach the anterior end such that the warmer is in the open positions and is easily resealable.

Figure 2:
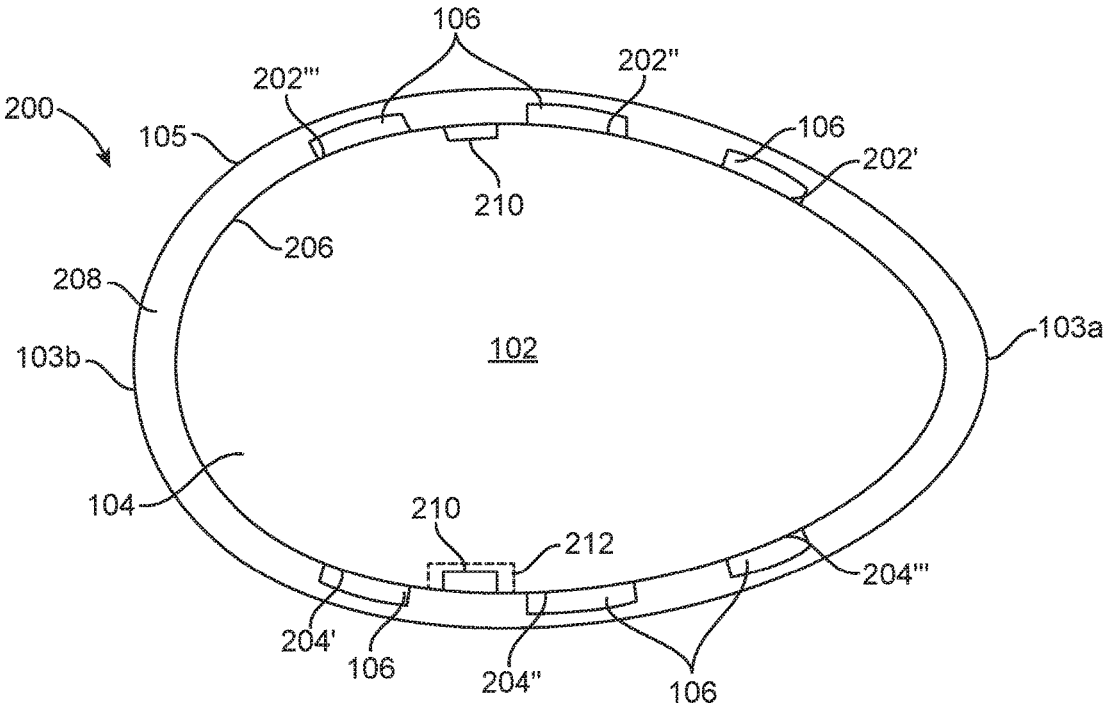
FIG. 2 is a front view of the insulated hand warmer of FIG. 1 in the open position in accordance with one embodiment of the present invention.

Referring now to FIG. 2, a front view down the anterior line of the hand warmer is shown generally at 200. For purposes of orientation, the central pocket 102, a first end 104, sides 103*a*, and 103*b*, and exterior shell 105, and sealing member 106 is shown. This end represents the anterior section 110 of the hand warmer.

In an embodiment of the present invention, the sealing members comprises elements that produce a magnetic field, such as permanent magnets having a opposite polarities, elements 202 and 204. Magnetic element 202 may comprise a "north pole" magnet, and element 204 may comprise the "south pole" magnet, or vice versa. The magnets produce their own magnetic field, and further respond to magnetic fields. The strength of the magnetic field produced is, at any given point, proportional to the magnitude of its magnetic moment. In operation, the magnets are configured having a magnetic field that is strong enough to pull the two ends of the hand warmer closed, but weak enough to allow a user to break the magnetic field and put their hand through the anterior end of the warmer by using low to moderate force.

In addition, when the magnet is put into an external magnetic field, produced by a different source, it is subject to a torque tending to orient the magnetic moment parallel to the field, bring the ends together to create a seal. Magnetic strip can be formed as a composite of magnetic powders combined with various resins (e.g., vinyl) or binders that can be injection molded into various shapes.

In an embodiment of the present invention, the sealing members 106/202 are disposed between the exterior 105, and the central pocket 102 in an annular space 208 in which there resides an insulating material between exterior wall 105 an interior space, the insulating material being filled with a layer of non-rigid, heat insulating material. The magnets 204 and 206 may be fixed within annular space using adhesives, snaps, rivets, and the like.

In optional embodiments, the magnets 204 and 206 may be disposed in the central pocket 102 such that they are visible to the user. In this way, weaker magnets may be used because there is no layer between the opposing polarities for magnets 204 and 206. Optionally, the central pocket 102, which defines the cylindrical side wall, can be formed of a single mater and single layer, and the sealing members can be fixed or attached thereto.

Referring still to FIG. 2, the hand warmer may further comprise heat source 210, which may be of any know source of heat, including heat formed through chemical action, mechanical action, microwave action, and the like. In optional embodiments of the present invention, should the heat source is not be built in, but rather held in a pocket 212, and may comprise air activated hand warmers comprising cellulose, iron, water, activated carbon, vermiculite and salt and produce heat from the exothermic oxidation of iron when exposed to air.

Figure 3:
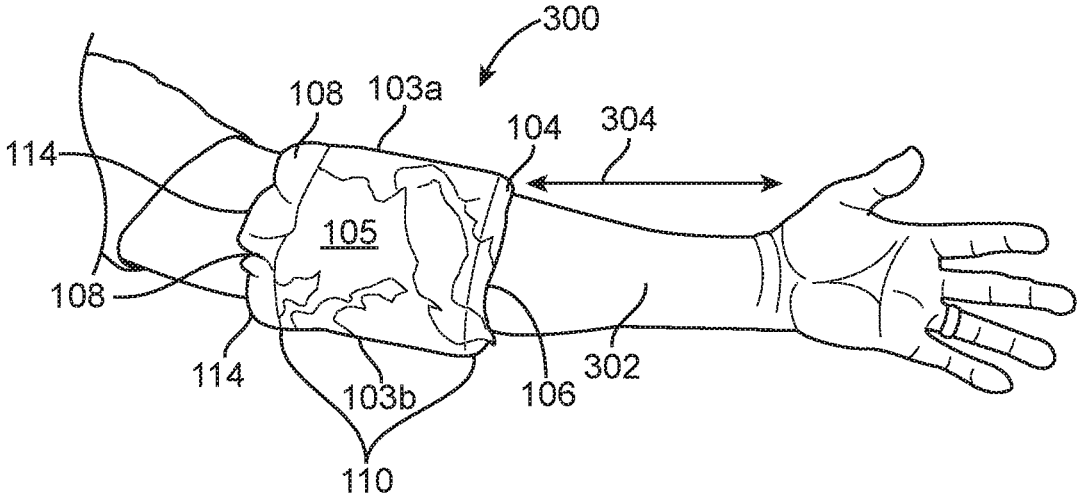
FIG. 3 is a perspective front view of the insulated hand warmer showing sealing members in accordance with one embodiment of the present invention.

Referring now to FIG. 3, a side view of the hand warmer is shown in its open position, positioned on the forearm of the user 302. For purposes of orientation, the first end 104, sides 103*a*, and 103*b*, and exterior shell 105, and sealing member 106 are shown. The anterior section 110 and the posterior section 108 is shown, together with cuff 114.

In this "open position" the sealing members 106 are detached so that the user can easily use his fingers and hand for an activity, such as bow hunting. The elastic cuff 114 easily stretches to accommodate the user's forearm, while still creating the seal required to retain the body heat generated by the user 302 in the internal central pocket. In operation, the user takes one hand, and applies a motive force, or "pull force" in direction of arrow 304. Referring back to FIG. 1, the "closed position" or "sealed position" is shown. In operation, the user 302 applies an opposite motive force or "push" force such that the warmer 100 cover the hand, and due to the polarity of the magnets disposed therein, the anterior end 110 automatically seals once the warmer is over or past the fingertips of the user.

Figure 4:
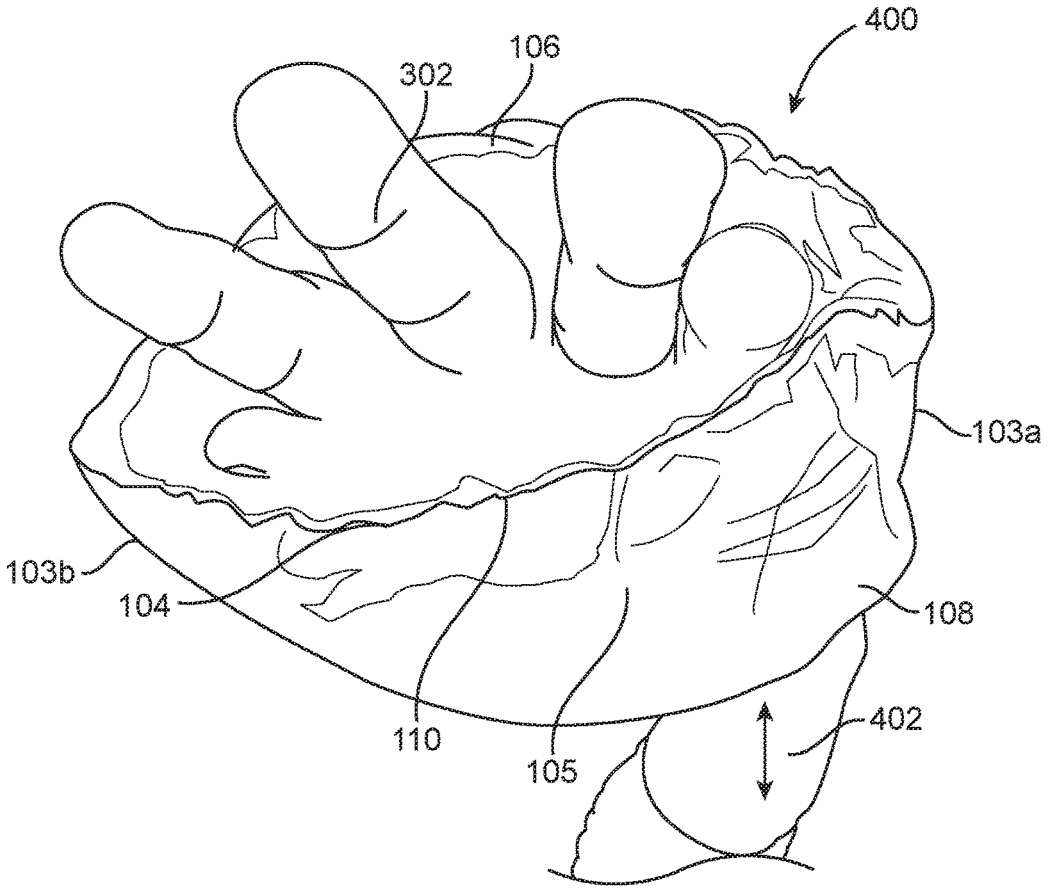
FIG. 4 is a cross sectional end view of the insulated hand warmer showing the cut away view of the central pocket for reception of the heating element and the insulation along the inside walls of the insulated hand warmer in accordance with one embodiment of the present invention.

Referring now to FIG. 4, a perspective front view looking down the barrel of the central pocket is shown generally at 400. The warmer is shown in its open position, positioned on the hand of the user, 302 representing another wearable position. For purposes of orientation, the first end 104, sides 103*a* and 103*b*, exterior shell 105, and sealing member 106 is shown. The anterior section 110 and the posterior section 108 are shown, together with the cuff 114.

In this "open position" the sealing members 106 are detached so that the user can easily use his fingers and hand for an activity, such as bow hunting. The elastic cuff 114 easily stretches to accommodate the user's forearm, while still creating the seal required to retain the body heat generated by the user 302, keeping the internal central pocket warm. In operation, the user takes one hand, and applies a motive force, or "pull force" in direction of arrow 402.

Figure 5:
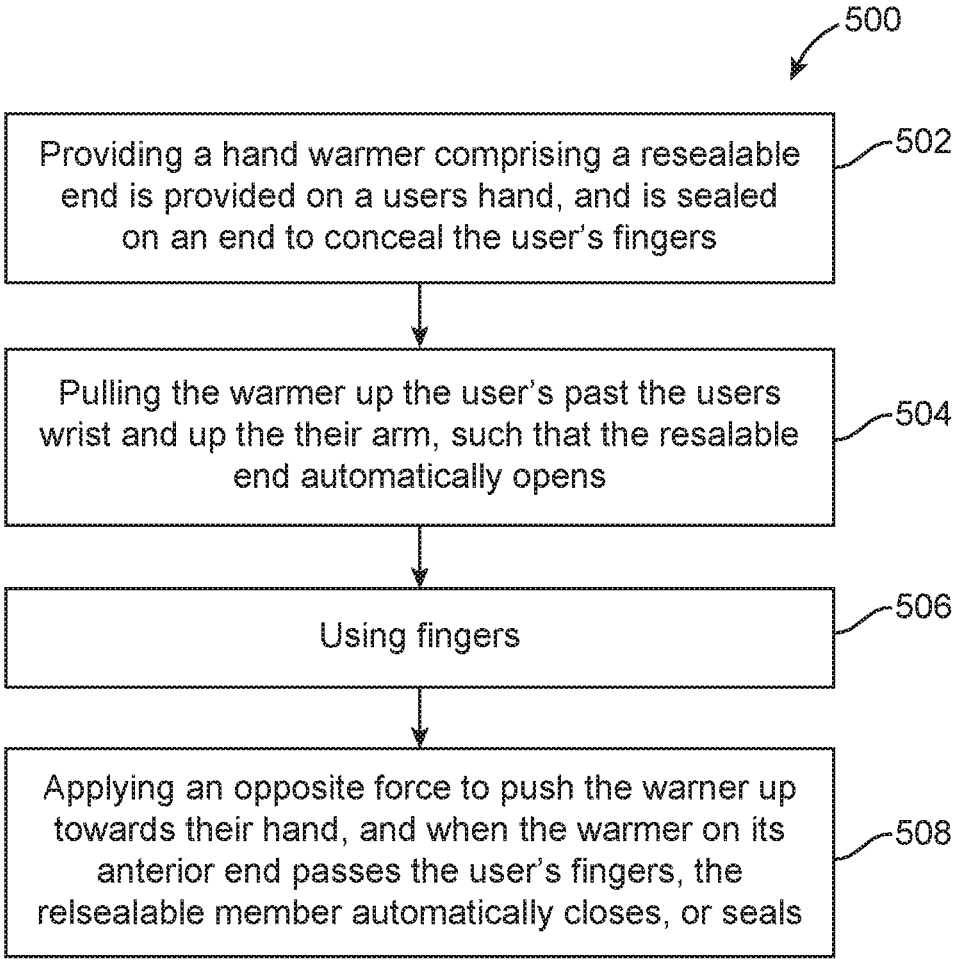
FIG. 5 is flow chart illustrating a step-wise method in accordance with embodiments of the present invention.

With reference now to FIG. 5, a step-wise flow chart depicting a method for protecting and charging a mobile device is shown generally at 500.

At step 502, hand warmer comprising a resealable end is provided on a user's hand, and is sealed on an end to conceal the user's fingers, such as that shown in FIGS. 1-4.

At step 504, a user pulls the warmer up the user's past the user's wrist and up the their arm, such that the resealable end automatically opens.

At step 506, the user is free to use his or her fingers.

At step 508, the user applies an opposite force to push the warmer up towards their hand, and when the warmer, on its anterior end, passes the user's fingers, the resealable member automatically closes, or seals.

Specific configurations and arrangements of the invention, discussed above with reference to the accompanying drawing, are for illustrative purposes only. Other configurations and arrangements that are within the purview of a skilled artisan can be made, used, or sold without departing from the spirit and scope of the invention. For example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures.

While the present invention has been described in connection with what are presently considered to be the most practical and preferred embodiments, it is to be understood that the present invention is not limited to these herein disclosed embodiments.

Although specific features of various embodiments of the invention may be shown in some drawings and not in others, this is for convenience only. In accordance with the principles of the invention, the feature(s) of one drawing may be combined with any or all of the features in any of the other drawings. The words "including," "comprising," "having," and "with" as used herein are to be interpreted broadly and comprehensively, and are not limited to any physical interconnection. Moreover, any embodiments disclosed herein are not to be interpreted as the only possible embodiments. Rather, modifications and other embodiments are intended to be included within the scope of the appended claims.

We claim:

1. A hand warmer comprising:

a central pocket defined by an approximately cylindrical housing; and a sealing member proximate an anterior end of the approximately cylindrical housing, wherein the sealing member is configured to switch positions from a closed position to an open position with an application of a pulling or a pushing force by the user in a direction parallel to an arm of the user;

wherein the sealing member comprises a series of magnets disposed within the central pocket, wherein the series of magnets comprise a first magnet having a first polarity disposed on a top interior edge, and a second magnet having an opposite polarity disposed opposite the first magnet on a bottom interior edge, such that the top and bottom adjacent ends are pulled closed by first and second opposing polarities.

2. The hand warmer of claim 1, wherein the series of magnets comprise magnetic strips.

3. The hand warmer of claim 1, further comprising an annular space defined between an exterior of the approximately cylindrical housing and an interior of the approximately cylindrical housing, wherein:

an insulating material is disposed in the annular space; and the sealing member is disposed in the annular space.

4. The hand warmer of claim 1, further comprising a cuff positioned proximate to a posterior section of the hand warmer, the cuff being configured to form a seal around an arm of the user.

5. The hand warmer of claim 1, further comprising a heat source disposed therein, wherein the heat source is disposed in a pocket defined in the interior of the central pocket.

6. A method of warming a user's hand, the method comprising:

providing a central pocket defined by an approximately cylindrical housing dimensioned to fit the hand of the user; and automatically sealing an end of the central pocket when the approximately cylindrical housing is pushed up an arm of the user to the user's hand and past the user's fingers;

wherein the sealing of an end of the central pocket comprises disposing a series of magnets within the central pocket, wherein the series of magnets comprise a first magnet having a first polarity disposed on a top interior edge, and a second magnet having an opposite polarity disposed opposite the first magnet on bottom interior edge such that the top and bottom adjacent ends are pulled closed by the first and second opposing magnets.

7. The method of claim 6, wherein the series of magnets comprise magnetic strips.

8. The method of claim 6, further comprising providing an annular space defined between an exterior of the housing and an interior of the housing, wherein:

an insulating material is disposed in the annular space; and the sealing member is disposed in the annular space.

9. The method of claim 6, further comprising sealing a posterior section of the hand warmer using a cuff, the cuff being configured to form a seal around the arm of the user.

10. The method of claim 6, further comprising heating the central pocket using a heat source disposed therein, wherein the heat source is disposed in a pocket defined in the interior of the central pocket.

* * * * *